US008096364B2

(12) United States Patent
Dursley

(10) Patent No.: US 8,096,364 B2
(45) Date of Patent: Jan. 17, 2012

(54) UMBILICAL DEPLOYMENT SYSTEM

(75) Inventor: Paul Dursley, Bristol (GB)

(73) Assignee: Vetco Gray Controls Limited, Nailsea, Bristol (GB)

( * ) Notice: Subject to any disclaimer, the term of this patent is extended or adjusted under 35 U.S.C. 154(b) by 0 days.

(21) Appl. No.: 12/157,669

(22) Filed: Jun. 12, 2008

(65) Prior Publication Data

US 2008/0308277 A1 Dec. 18, 2008

(30) Foreign Application Priority Data

Jun. 15, 2007 (GB) ..... 0711569.4

(51) Int. Cl.
*E21B 43/01* (2006.01)

(52) U.S. Cl. ..... 166/338; 166/339; 166/344; 166/347; 166/352; 166/368; 405/158; 405/173

(58) Field of Classification Search ..... 166/338, 166/339, 341, 343, 344, 347, 367, 368, 345, 166/350–352; 405/158, 169, 173
See application file for complete search history.

(56) References Cited

U.S. PATENT DOCUMENTS

| | | | | | |
|---|---|---|---|---|---|
| 4,650,431 | A * | 3/1987 | Kentosh | 441/5 |
| 4,682,913 | A * | 7/1987 | Shatto et al. | 405/169 |
| 4,793,737 | A * | 12/1988 | Shotbolt | 405/169 |
| 5,007,482 | A * | 4/1991 | Forsyth et al. | 166/345 |
| 5,341,884 | A * | 8/1994 | Silva | 166/347 |
| 5,505,560 | A * | 4/1996 | Brown et al. | 405/195.1 |
| 5,582,252 | A * | 12/1996 | Richmond et al. | 166/352 |
| 5,722,793 | A * | 3/1998 | Peterson | 405/164 |
| 6,102,124 | A * | 8/2000 | Skeels et al. | 166/347 |
| 6,109,833 | A * | 8/2000 | Savy | 405/195.1 |
| 6,206,742 | B1 * | 3/2001 | Bull et al. | 441/1 |
| 6,223,675 | B1 * | 5/2001 | Watt et al. | 114/312 |
| 6,588,980 | B2 * | 7/2003 | Worman et al. | 405/158 |
| 6,742,594 | B2 * | 6/2004 | Langford et al. | 166/350 |
| 6,776,559 | B1 * | 8/2004 | Peterson | 405/158 |
| 6,796,261 | B2 * | 9/2004 | Colyer | 114/258 |
| 7,032,658 | B2 | 4/2006 | Chitwood et al. | |
| 7,194,913 | B2 * | 3/2007 | Morrison et al. | 73/800 |
| 2002/0040782 | A1 | 4/2002 | Rytlewski et al. | |
| 2003/0106714 | A1 * | 6/2003 | Smith et al. | 175/6 |
| 2005/0276665 | A1 * | 12/2005 | Entralgo et al. | 405/190 |
| 2007/0044972 | A1 * | 3/2007 | Roveri et al. | 166/367 |

FOREIGN PATENT DOCUMENTS

| | | | |
|---|---|---|---|
| EP | 0 387 076 | A | 9/1990 |
| GB | 2401164 | A | 11/2004 |
| GB | 2 425 565 | A | 11/2006 |
| GB | 2 440 337 | A | 1/2008 |
| WO | WO 01/21479 | A1 | 3/2001 |
| WO | WO 2005/010316 | A | 2/2005 |

* cited by examiner

*Primary Examiner* — Thomas Beach
*Assistant Examiner* — Matthew Buck
(74) *Attorney, Agent, or Firm* — Bracewell & Giuliani LLP

(57) ABSTRACT

A method for providing an umbilical connection for a well installation, the well installation being located at the bed or floor of a body of water, comprises the steps of providing an umbilical with first and second ends and prior to operative deployment of the umbilical, locating the umbilical such that at least a portion of the umbilical is substantially statically retained within the body of water. Additionally, an umbilical deployment system for a well installation located at the bed or floor of a body of water, comprises an umbilical, wherein, prior to operative deployment of the umbilical, at least a portion of the umbilical is substantially statically retained within the body of water.

17 Claims, 3 Drawing Sheets

FIG. 1 - Prior Art

UMBILICAL DEPLOYMENT SYSTEM

CROSS-REFERENCE TO RELATED APPLICATION

This application claims the benefit of United Kingdom Patent Application No. 0711569.4,filed on Jun. 15, 2007, which hereby is incorporated by reference in its entirety.

FIELD OF THE INVENTION

This invention relates to a method for providing an umbilical connection for a well installation, and an umbilical deployment system for a well installation located at the bed or floor of a body of water. The well installation may for example be a subsea hydrocarbon extraction well, although such installations may equally be located in bodies of water such as lakes.

BACKGROUND OF THE INVENTION

Control, monitoring and powering of a subsea hydrocarbon fluid production well for example is effected from a surface or land-based platform via an umbilical cable which carries the necessary electric/hydraulic power lines and electrical/optical communication lines. This umbilical is connected at its lower end to, typically, a subsea control and distribution unit (CDU), with the control signals/power being distributed to the various trees at the well heads on the sea bed as required. In the event of a failure of the umbilical a Back-Up Intervention Control (BUIC) system may be employed to replace the services normally provided by the umbilical in order to continue fluid production from the well until the umbilical is repaired. A BUIC system is effectively an insurance policy against failure of the prime controls umbilical, and is typically purchased where the prime umbilical is considered sufficiently vulnerable. A BUIC system is designed to be deployed only when a failure in the prime umbilical occurs, and a vessel is used for this deployment. Since the cost of maintaining a vessel to provide this service is prohibitive, most well operators opt for a BUIC system that employs a "vessel of opportunity" with limited facilities. While there-is generally assistance from a Remote Operated Vehicle (ROV) to enable disconnection of the umbilical and connection of the back-up umbilical at the CDU, there is generally no lift assistance available.

A typical deployment of a BUIC system is shown in FIG. 1. A vessel 1, for example a vessel of opportunity, carries a replacement dynamic umbilical 2 stowed on a reel/winch assembly 3. The assembly 3 is integrated with a handling/overboarding mechanism used to deploy the umbilical 2. Integrated into this system is an Emergency Quick Disconnect Package (EQDP) 4 which permits simple disconnection of the umbilical 2. Furthermore, the umbilical 2 may include buoyancy devices 5 to support the umbilical within the water. The umbilical 2, and umbilical-mounted half of the EQDP 4 are typically stowed on the reel 3 for handling through the handling/overboarding mechanism. The buoyancy devices 5 may also be stowed on the reel 3 if the operator requests this facility, alternatively they may be attached to the umbilical on installation. The lower end of the umbilical is connected to a subsea umbilical termination (SUT) 6. This provides connection with a CDU 8 via CDU receptacle 7.

To deploy the umbilical 2, it is wound from the reel 3, through the handling/overboard mechanism and over the side of the vessel 1. The umbilical 2 is required to support its own weight, plus that of the SUT 6, through the water column under the prevailing weather, sea and current conditions. For connection with the well installation, the umbilical 2 and its termination 6 must be presented directly above and correctly oriented to the receptacle 7. This is often possible in light weather and sea conditions, but is unlikely to be successful in any other sea state, and is a difficult and thus expensive exercise. The vessel of opportunity is unlikely to be as stable a platform as a larger installation vessel, and will therefore have greater pitch, heave and roll motions for any given set of weather or sea conditions. Such a vessel does not generally have a moonpool facility, which means that overboarding of the umbilical, in the worst case scenario, has to be over the stem of the vessel. This is probably the worst location at which to overboard a dynamic umbilical when trying to position the SUT at installation.

SUMMARY OF THE INVENTION

It is an aim of the present invention to overcome these problems by providing a new method and system for deploying an umbilical so as to enable a "predeployed" umbilical, which may be installed at the same time as the main production umbilical and is retained within the body of water during the normal operation of the well, so that its operative connection may be effected quickly and easily, without depending on accurate vessel positioning. Potentially, a smaller vessel may also be used to effect connection.

With such a system, instead of requiring full installation of the umbilical, one end of the umbilical is recovered and lifted up to a connection system on the vessel.

A system and method in accordance with the present invention confers many advantages, for example:

- no lift assistance is necessary;
- very accurate vessel maneuvering is not required;
- manpower requirements are reduced;
- weather and sea state conditions are of less influence, this leads in turn to a potentially wider weather/sea state intervention window;
- the mechanical systems within the BUIC system are simplified, as there is no requirement for umbilical stowage on a reel or an overboarding/handling mechanism. Only a winch is required;
- reduced mechanical risk to the umbilical and SUT during an intervention;
- the EQDP does not have to be stowed on a reel or handled through an overboarding/handling mechanism;
- reduced size and weight of ship-borne BUICS equipment;
- no buoyancy handling or attachment issues on the vessel. Buoyancy does not have to withstand stowage crushing forces on a reel or winch;
- reduced crane lift capability at mobilization and demobilization;
- reduced onshore storage provision as neither an umbilical nor storage reel need be kept onshore;
- greater potential to automate or semi-automate ship-borne mechanical BUICS functions; and
- quicker mobilization of dockside-stored BUICS equipment.

In accordance with a first aspect of the present invention there is provided a method for providing an umbilical connection for a well installation as set out in the accompanying claims.

In accordance with a second aspect of the present invention there is provided an umbilical deployment system for a well installation located at the bed or floor of a body of water.

BRIEF DESCRIPTION OF THE DRAWINGS

The invention will now be described, by way of example, with reference to the accompanying drawings, in which.

DETAILED DESCRIPTION OF THE INVENTION

A system in accordance with the present invention may be installed in a number of ways, depending on the results of a dynamic analysis of the umbilical and the recommendations as to its installed configuration, for example "Lazy Wave", "Steep Wave" or simple catenary. Various installation possibilities are shown in FIGS. 2 to 4.

Figure 1:
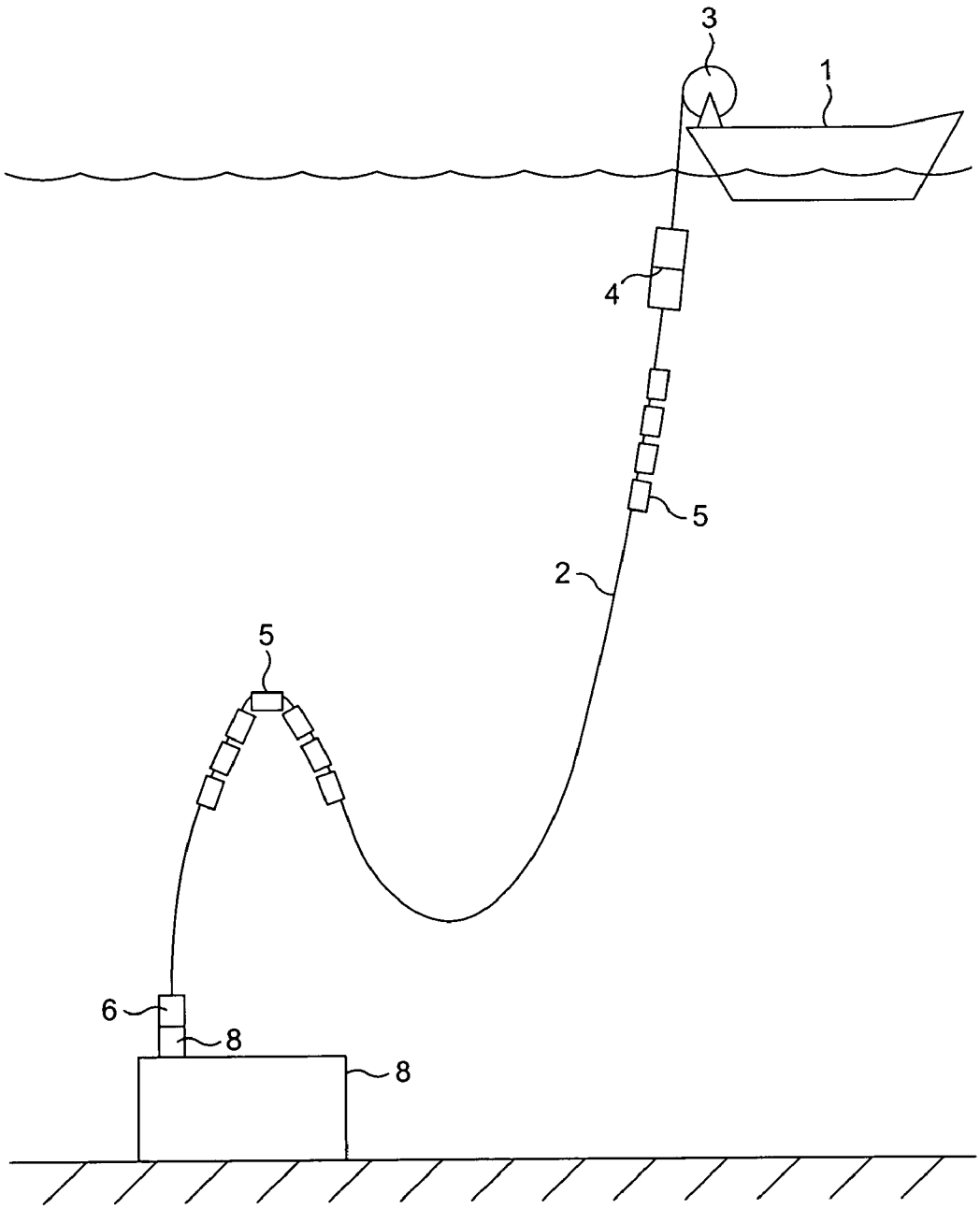
FIG. 1 shows a conventional umbilical deployment technique.
Figure 2:
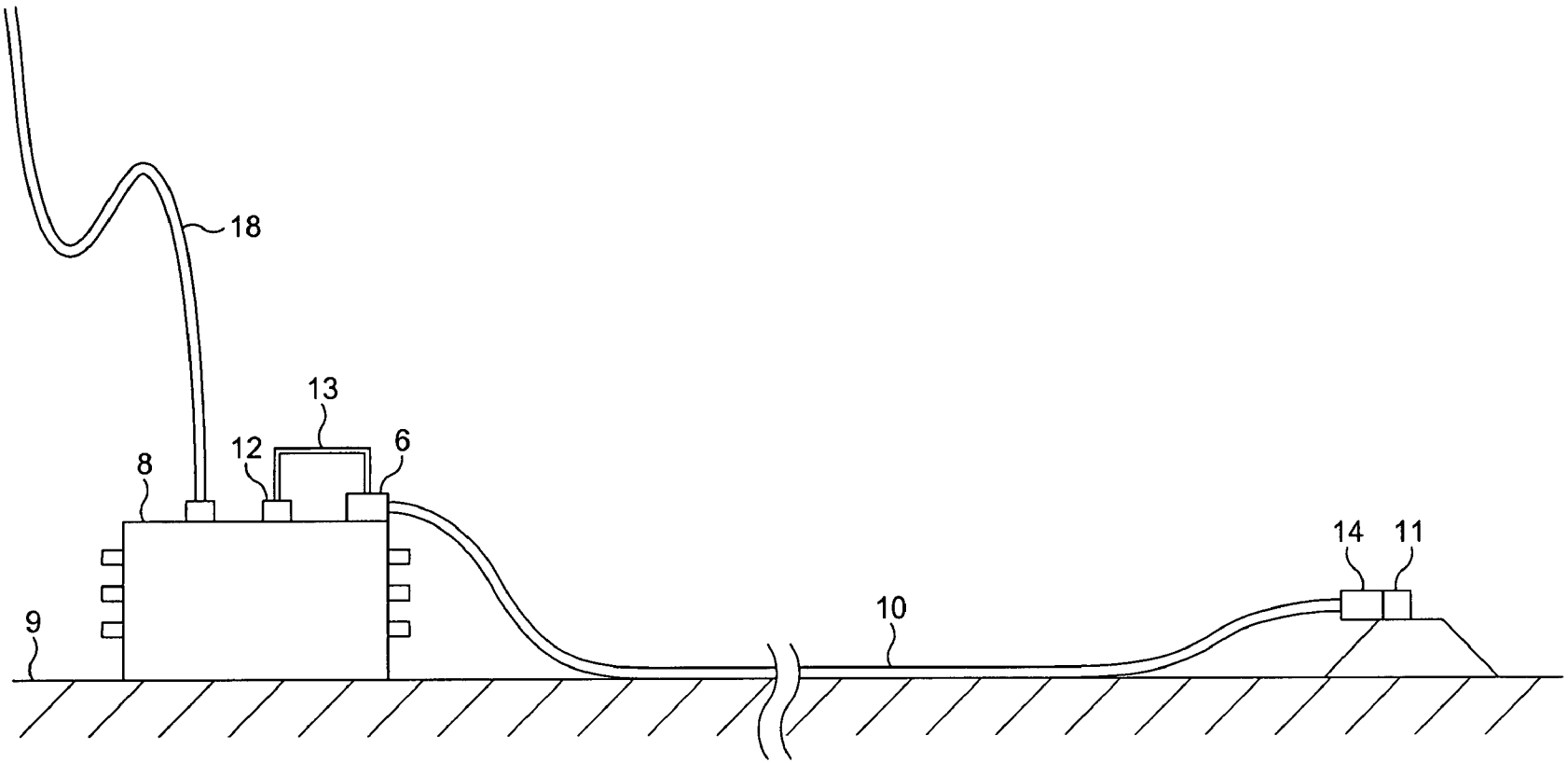
FIG. 2 shows a first embodiment of a pre-deployed umbilical system in accordance with the present invention.

A comparatively simple system to install is shown in FIG. 2, where a simple catenary is shown to be a viable solution. A back-up umbilical 10 is laid out on the seabed 9, which may be carried out at the same time as installation of main umbilical 18, so as to be retained in a substantially static position. One end of the umbilical 10 finishes in a recoverable SUT 6, which is connected to CDU 8. The CDU 8 has BUIC ports 12 for hydraulic and/or electrical power and electrical and/or optical communications as required, the ports 12 being linked by jumpers 13 to the SUT 6. The other end of the umbilical 10 finishes in a connector 14, which forms half of an EQDP. Connector 14 is releasably connected to a parking unit 11. Parking unit 11 lies on the seabed due to the combined weight of the parking unit 11 and umbilical 10, resting on or in a predeployed storage base (not shown) and acts to protect the end of umbilical 10.

To effect operative deployment of the umbilical 10, an ROV (not shown) takes a lift line from a winch on a surface vessel or platform and attaches it to the connector 14 or parking unit 11. The winch then lifts the connector 14 end of the umbilical 10, together with the parking unit 11, up to the surface platform/vessel, where the umbilical 10 is connected to the BUIC system housed thereon.

Figure 3:
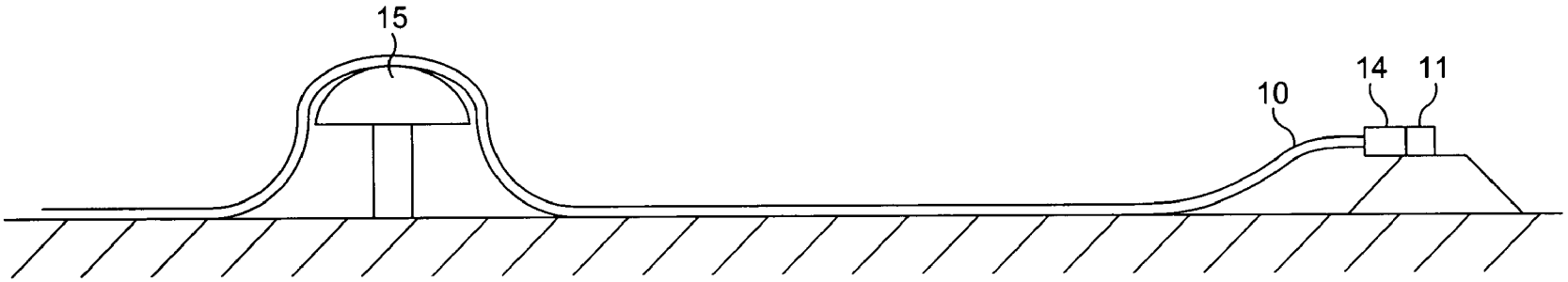
FIG. 3 shows a second embodiment of a system in accordance with the present invention.
Figure 4:
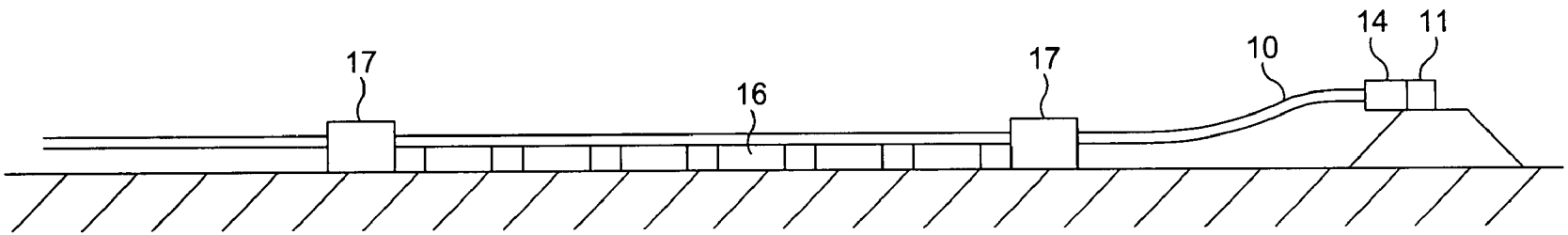
FIG. 4 shows a third embodiment of a system in accordance with the present invention.

FIG. 3 shows part of an alternative arrangement, used for example where it is determined that a "Lazy Wave" configuration is required. In this embodiment, deflection means 15, in this case a buoyant arch, is used to support a portion of the umbilical 10, to arrange it in a non-linear fashion and thus introduce slack into the umbilical, which decouples vessel motions (and therefore loads) from the SUT interface to the CDU.

FIG. 4 shows part of an alternative arrangement, in which the umbilical 10 is provided with buoyancy modules 16 positioned as required along its length. These act to reduce the load weight on the EQDP under both static and dynamic heave conditions. The buoyancy modules 16 are held to the seabed by tethering to clump weights 17. Weights 17 are detachable from the umbilical 10 by an ROV. The above-described embodiments are exemplary only, and various possibilities are possible within the scope of the claims.

The buoyancy means shown in FIG. 4 may be used in conjunction with the deflection means of FIG. 3.

Confidence in the health of the umbilical can be achieved by incorporating a cross connection system in the parking unit, allowing electrical power and fibre-optic communications to be looped between the multiple paths normally incorporated in the umbilical for monitoring purposes.

The invention claimed is:

1. A method of connecting an umbilical to a well installation at the bed or floor of a body of water, the method comprising:

a) providing a back-up umbilical having first and second ends, with the second end being connected to a control and distribution unit to which a main production umbilical is also coupled, wherein the back-up umbilical is configured to replace the main production umbilical;

b) prior to operative deployment of the back-up umbilical, locating the back-up umbilical such that at least a portion of the back-up umbilical is statically retained within the body of water;

c) providing a parking unit on the bed of the body of water; and d) connecting the first end of the back-up umbilical to the parking unit.

2. A method according to claim 1, wherein in step b), the back-up umbilical is retained proximate the bed or floor of the body of water.

3. A method according to claim 1, further comprising e) lifting the first end of the back-up umbilical to a platform at the surface of the body of water.

4. A method according to claim 3, wherein step e) is carried out using a remote operated vehicle.

5. A method according to claim 1, further comprising providing a buoyancy module with the back-up umbilical.

6. A method according to claim 1, further comprising providing slack in the back-up umbilical.

7. A method according to claim 1, further comprising monitoring the health of the back-up umbilical during retention.

8. A method according to claim 7, further comprising providing a parking unit and monitoring the health of the back-up umbilical by passing signals through the back-up umbilical via the parking unit.

9. An umbilical deployment system for a well installation located at the bed or floor of a body of water comprising:

a back-up umbilical having first and second ends with the second end coupled to a control and distribution unit, and wherein, prior to operative deployment of the back-up umbilical, having a portion of the back-up umbilical substantially statically retained within the body of water;

a main production umbilical coupled to the control and distribution unit at the well installation, wherein the back-up umbilical is configured to replace the main production umbilical; and a parking unit, with the first end of the back-up umbilical being connected to the parking unit prior to operative deployment.

10. A system according to claim 9, wherein, prior to deployment, the portion of the back-up umbilical is retained substantially proximate the bed or floor of the body of water.

11. A system according to claim 9, wherein the first end is releasably connected to the parking unit.

12. A system according to claim 9, further comprising deflection means to retain the back-up umbilical in a non-linear configuration prior to deployment.

13. A system according to claim 12, wherein the deflection means is secured to the bed or floor of the body of water.

14. A system according to claim 12, wherein the deflection means comprises a support for raising a portion of the back-up umbilical.

15. A system according to claim 9, further comprising a buoyancy module attached to the back-up umbilical.

16. A system according to claim 9, further comprising means for monitoring the health of the back-up umbilical prior to deployment.

17. A system according to claim 16, further comprising a parking unit which, prior to deployment, is connected to an end of the back-up umbilical and wherein the monitoring means comprises means for passing signals through the back-up umbilical via the parking unit.

* * * * *